US009211757B2

(12) United States Patent
Osborne

(10) Patent No.: US 9,211,757 B2
(45) Date of Patent: Dec. 15, 2015

(54) TWIRLING WRITING INSTRUMENT BODIES AND TWIRLING ACCESSORIES FOR WRITING INSTRUMENTS

(71) Applicant: Morgan K. Osborne, La Jolla, CA (US)

(72) Inventor: Morgan K. Osborne, La Jolla, CA (US)

( * ) Notice: Subject to any disclaimer, the term of this patent is extended or adjusted under 35 U.S.C. 154(b) by 457 days.

(21) Appl. No.: 13/770,916

(22) Filed: Feb. 19, 2013

(65) Prior Publication Data

US 2014/0112696 A1 Apr. 24, 2014

Related U.S. Application Data

(60) Provisional application No. 61/716,722, filed on Oct. 22, 2012, provisional application No. 61/716,758, filed on Oct. 22, 2012, provisional application No. 61/716,774, filed on Oct. 22, 2012, provisional application No. 61/716,795, filed on Oct. 22, 2012.

(51) Int. Cl.
*B43K 29/00* (2006.01)
*B43K 23/00* (2006.01)

(52) U.S. Cl.
CPC ..... *B43K 29/00* (2013.01); *B43K 23/001* (2013.01)

(58) Field of Classification Search
CPC combination set(s) only.
See application file for complete search history.

(56) References Cited

U.S. PATENT DOCUMENTS

| | | | | | |
|---|---|---|---|---|---|
| 974,887 | A | * | 11/1910 | Huddle | 401/8 |
| 1,094,888 | A | * | 4/1914 | Ehrle | 401/8 |
| 2,812,683 | A | * | 11/1957 | Harrold et al. | 84/477 B |
| 3,120,147 | A | * | 2/1964 | Fietcher | 84/477 B |
| 3,402,984 | A | * | 9/1968 | Zazzara | 401/8 |
| 3,636,811 | A | | 1/1972 | Bailey | |
| 4,865,285 | A | * | 9/1989 | Gaggianese | 248/309.4 |
| 5,286,577 | A | * | 2/1994 | Premkumar et al. | 428/558 |
| 5,944,433 | A | * | 8/1999 | O'Mara et al. | 401/8 |

* cited by examiner

*Primary Examiner* — David Walczak
(74) *Attorney, Agent, or Firm* — DASCENZO Intellectual Property Law, P.C.

(57) ABSTRACT

Twirling writing instrument bodies include a writing instrument body, a gripping member, and a rotary assembly that is configured to facilitate selective twirling of the writing instrument body relative to the gripping member by a user. Twirling accessories for writing instruments include a gripping member, a connector that is configured to be operatively coupled to a writing instrument body, and a rotary assembly that is configured to facilitate selective twirling of the connector relative to the gripping member.

39 Claims, 5 Drawing Sheets

TWIRLING WRITING INSTRUMENT BODIES AND TWIRLING ACCESSORIES FOR WRITING INSTRUMENTS

RELATED APPLICATIONS

This application claims priority to U.S. Provisional Patent Application Ser. No. 61/716,722, filed on Oct. 22, 2012 and entitled "ATTACHABLE ROTARY MOTION FOR WRITING INSTRUMENTS," U.S. Provisional Patent Application Ser. No. 61/716,758, filed on Oct. 22, 2012 and entitled "ATTACHABLE ROTARY MOTION WITH SOCKET FOR WRITING INSTRUMENTS," U.S. Provisional Patent Application Ser. No. 61/716,774, filed on Oct. 22, 2012 and entitled "WRITING INSTRUMENT BODY EQUIPPED WITH ROTARY MOTION," and U.S. Provisional Patent Application Ser. No. 61/716,795, filed on Oct. 22, 2012 and entitled "WRITING INSTRUMENT BODY EQUIPPED WITH ROTARY MOTION WITH SOCKET," the disclosures of which are incorporated herein by reference.

FIELD OF THE DISCLOSURE

The present disclosure relates to writing instruments and amusement devices.

BACKGROUND OF THE DISCLOSURE

Writing instruments are inherently limited to marking. When not being used to mark, a writing instrument generally ceases to have a purpose or serve a purpose. Some non-exclusive examples of when a user may be holding a writing instrument and not actively marking with it, would include but not be limited to, when contemplating what to write prior to actually writing, while listening to someone or something which may require writing, when following a period of writing, etc. In addition, during such times and others, writing instruments are extremely limited in their manner and method of being held by a user during times in which the user is not actively marking. Accordingly, a user may find that a writing instrument fails to provide options for holding and/or desired stimulation or amusement during periods in which the writing instrument is not being used actively to mark.

SUMMARY OF THE DISCLOSURE

Twirling writing instrument bodies and twirling accessories for writing instruments are disclosed herein.

A twirling writing instrument body according to the present disclosure includes a writing instrument body, a gripping member, and a rotary assembly that operatively couples the gripping member to the writing instrument body. The rotary assembly facilitates selective twirling of the writing instrument body relative to the gripping member by a user.

A twirling accessory according to the present disclosure includes a gripping member, a connector configured to be operatively coupled to a writing instrument, and a rotary assembly that operatively couples the gripping member to the connector. The rotary assembly facilitates selective twirling of the connector relative to the gripping member by a user, and thus selective twirling of a writing instrument relative to the gripping member when the connector is operatively coupled to a writing instrument.

BRIEF DESCRIPTION OF THE DRAWINGS

FIG. 15 also represents a perspective view of an illustrative, non-exclusive example of a twirling accessory operatively coupled to a writing instrument body, with the twirling accessory being held by a user and with the user twirling the writing instrument body.

FIG. 16 also represents a perspective view of an illustrative, non-exclusive example of a twirling accessory operatively coupled to a writing instrument body, with the twirling accessory being held by a user and with the user twirling the writing instrument body.

DETAILED DESCRIPTION OF THE DISCLOSURE

Figure 1:
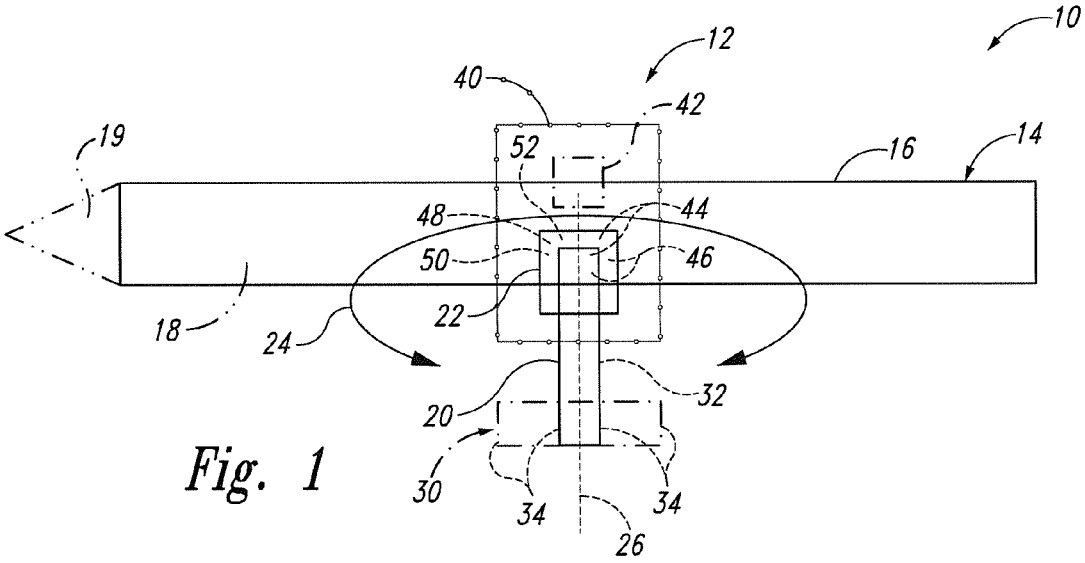
FIG. 1 is a schematic side view diagram representing illustrative, non-exclusive examples of twirling writing instrument bodies and twirling accessories for writing instruments.

Twirling writing instrument bodies (also referenced herein as "twirling writing instrument body") and twirling accessories (also referenced herein as "twirling accessory") according to the present disclosure are schematically represented in FIG. 1 and are indicated generally at 10 and 12, respectively. Twirling writing instrument bodies 10 and twirling accessories 12 may be described as amusement devices, holding instruments, and/or toys, and are configured for selective twirling of a writing instrument 14 (in which they are incorporated or to which they are operatively coupled) by a user. That is, twirling writing instrument bodies 10 and twirling accessories 12 according to the present disclosure are configured to permit a user to hold, twirl, spin, rotate, and/or otherwise play with a writing instrument 14 for amusement and joy. As illustrative, non-exclusive examples, a user may twirl a writing instrument 14 between periods of writing, when contemplating what to write, when finished writing, when contemplating matters unrelated to writing, when listening to a lecture, when performing tasks other than writing, etc.

As schematically illustrated in FIG. 1, a writing instrument 14 may be described as including a writing instrument body 16, which in the context of twirling writing instrument bodies 10 according to the present disclosure a twirling writing instrument body 10 may or may not be described as being, that writing instrument body 16 of a writing instrument 14. In the context of twirling accessories 12 according to the present disclosure, a twirling accessory 12 is configured to be operatively coupled to a writing instrument body 16 of a writing instrument 14.

As used herein, a writing instrument body 16 may take any suitable form and generally relates to a tool that is specifically configured and designed for usage with a writing instrument 14 by being grasped by a user and for marking on a substrate, item, or surface, such as (but not limited to) paper, plastic, walls, electronic screens, touch screens, monitors, etc. Illustrative, non-exclusive examples of writing instruments 14 include (but are not limited to) pens, pencils, markers of various types and configurations, styluses, etc. As schematically represented in FIG. 1, a writing instrument 14 may incorporate a twirling writing instrument body 10 and/or may be a writing instrument 14 with which a twirling accessory 12 is configured to be used or is being used. Some writing instruments 14 also may include a supply of marking material 18 (represented in dash-double-dot lines), such as (but not limited to) graphite, ink, paint, chalk, etc., that is supported and/or protected by a writing instrument body 16 (or in the case of the present disclosure, a twirling writing instrument body 10) of the writing instrument 14 for selective marking of a substrate, item, or surface by a user. Additionally or alternatively, a twirling writing instrument body 10 and/or a writing instrument body 16 may be attached to, support, and/or protect other structure 19 (represented in dash-double-dot lines) such as delivery systems and/or delivery structure for marking material 18, or electronic or virtual marking, such as (but not limited to) magnets, electric indictors, pressure-based delivery structure, etc. Typically, writing instrument bodies 16 of writing instruments 14 have a length in a range that normally does not exceed 18 inches, and which usually is, but is not exclusively, in the range of 1-10 inches, and a diameter that normally does not exceed 6 inches, and which usually is, but is not exclusively, in the range of 1/32-1 inch; however, sizes of twirling writing instrument bodies 10 and/or writing instrument bodies 16 of writing instruments 14 outside of these ranges are within the scope of the present disclosure. Twirling writing instrument bodies 10 and/or writing instrument bodies 16 may be constructed of any suitable materials, including (but not limited to) plastic, metal, or wood.

As schematically illustrated in FIG. 1, twirling writing instrument bodies 10 according to the present disclosure include a writing instrument body 16, a gripping member 20 that is configured to be grasped by a user, and a rotary assembly 22 that operatively couples the gripping member 20 to the writing instrument body 16. As used in previous sections and throughout herein, "operatively coupled" and variations thereof and/or similar terms thereto, mean that components that are coupled together may be coupled together (for example (but not limited to), affixed, glued, welded, forged, molded, screwed, fastened, intertwined, locked, clipped, clasped, held, socketed, connected, or attached together), such that the components directly engage each other, or may be indirectly coupled together, such that the components do not directly engage each other. Additionally, each component involved and its intended coupling component may be "operatively coupled" differently (or the same) to how either component may then be (but not always required to be as it depends on the circumstances) "operatively coupled" to any additional component or components. Additionally, "operatively coupled" may take into account multiple components (including any subcomponents thereof) "operatively coupling" to multiple intended coupling components (including any intended coupling subcomponents thereof). Furthermore, "operatively coupling" involving two or more components (and any subcomponents thereof) may occur, result, or be in a permanent fashion or a temporary fashion, each of which may be different (or the same) to how any other component or components (or any subcomponent or subcomponents) may be "operatively coupled" to any additional component or components (or any subcomponent or subcomponents). Such definitional term for "operatively coupled" is not limiting in any way (or restricted to being performed only in a certain way) as varying contexts and/or circumstances may be involved as numerous embodiments are possible, and each may have a different manner, design, manufacturing, method, or variation with respect to "operatively coupling."

Twirling writing instrument bodies 10 may or may not also accommodate, hold, protect, and/or act as support for marking material 18, other structure 19, and/or other components typically associated with writing instruments 14. That is, twirling writing instrument bodies 10 may be manufactured, sold, or otherwise provided with a gripping member 20 and/or a rotary assembly 22 without also including other standard components of writing instruments 14. Accordingly, a twirling writing instrument body 10 may be supplied to another party or to an end user who may or may not provide, install, and/or incorporate such additional components as a supply of marking material 18.

As also schematically illustrated in FIG. 1, twirling accessories 12 according to the present disclosure include a gripping member 20, a connector 40 that is configured to be operatively coupled to a writing instrument 14, and a rotary assembly 22 that operatively couples the gripping member 20 to the connector 40. In FIG. 1, the connector 40 is represented in line-circle lines, schematically representing that a twirling accessory 12 may be a distinct structure from a writing instrument body 16. A twirling accessory 12 additionally or alternatively may be described as an accessory for a standard, or off-the-shelf, writing instrument 14. As a non-exclusive example, a twirling accessory 12 may be designed and/or sold as an after-market attachment for writing instruments 14, and/or may be designed and/or sold together with a standard (e.g., off-the-shelf) or specifically designed writing instrument 14.

In a non-exclusive example of a twirling writing instrument body 10, the rotary assembly 22 facilitates, provides, and/or permits, selective twirling of the writing instrument body 16 relative to the gripping member 20 by a user, as schematically represented by the double-headed arrow at 24 in FIG. 1. Accordingly, the rotary assembly 22 may be described as defining an axis of rotation 26, about which the writing instrument body 16 selectively may be rotated by a user. In a non-exclusive example of a twirling accessory 12, the rotary assembly 22 facilitates selective twirling of the connector 40 relative to the gripping member 20 by a user, and also facilitates selective twirling of a writing instrument 14 relative to the gripping member 20 by a user when the connector 40 is operatively coupled to the writing instrument body 16 of a writing instrument 14.

In FIG. 1, the rotary assembly 22 is illustrated schematically in an overlapping relationship with the writing instrument body 16 and the gripping member 20, schematically representing that with a twirling writing instrument body 10, the rotary assembly 22 at least in part may be defined by the writing instrument body 16 and/or the gripping member 20. Additionally or alternatively, the rotary assembly 22 may be (and/or may include component parts that are) distinct from the writing instrument body 16 and/or the gripping member 20. Regardless of the configuration of the rotary assembly 22 of a twirling writing instrument body 10, the rotary assembly 22 is configured to permit a user to grasp the gripping member 20, for example, in one hand, and then to selectively twirl, spin, and/or rotate the writing instrument body 16 relative to the gripping member 20 with the user's remaining fingers not being used to grasp the gripping member 20 or alternatively with the user's other hand. Typically, although not required, the rotary assembly 22 may be configured to facilitate selective twirling of the writing instrument body 16 relative to the gripping member 20 by a user for an undefined number of rotations in one or both rotational directions. In other words, the rotary assembly 22 may not restrict the number of rotations that a writing instrument body 16 may be rotated relative to the gripping member 20. As a non-exclusive example, in some embodiments, the rotary assembly 22 does not include or define, and is not defined by, threaded structures that effectuate the permitted selective twirling of a writing instrument body 16 relative to a gripping member 20, with the threaded structures resulting in the rotary assembly 22 bottoming-out in one or both rotational directions and/or resulting in the gripping member 20 decoupling from the writing instrument body 16. However, it is within the scope of the present disclosure that in some embodiments of twirling writing instrument bodies 10, threaded structures may be used to define the rotational relationship between the gripping member 20 and the writing instrument body 16.

Similarly, with a twirling accessory 12, the rotary assembly 22 at least in part may be defined by the connector 40 and/or the gripping member 20. Additionally or alternatively, the rotary assembly 22 may be (and/or may include component parts that are) distinct from the connector 40 and/or the gripping member 20. Regardless of the configuration of the rotary assembly 22 of a twirling accessory 12, the rotary assembly 22 is configured to permit a user to grasp the gripping member 20, for example, in one hand, and then to selectively twirl, spin, and/or rotate the connector 40 relative to the gripping member 20 by twirling an operatively coupled writing instrument 14 with the user's remaining fingers not being used to grasp the gripping member 20 or alternatively with the user's other hand. Typically, although not required, the rotary assembly 22 of a twirling accessory 12 may be configured to facilitate selective twirling of the connector 40 relative to the gripping member 20 for an undefined number of rotations in one or both rotational directions. In other words, the rotary assembly 22 may not restrict the number of rotations that the connector 40 may be rotated relative to the gripping member 20. As a non-exclusive example, in some embodiments, the rotary assembly 22 does not include or define, and is not defined by, threaded structures resulting in the rotary assembly 22 bottoming-out in one or both rotational directions and/or resulting in the gripping member 20 decoupling from the connector 40. However, it is within the scope of the present disclosure that in some embodiments of twirling accessories 12, threaded structures may be used to define the rotational relationship between the gripping member 20 and the connector 40.

Figure 2:
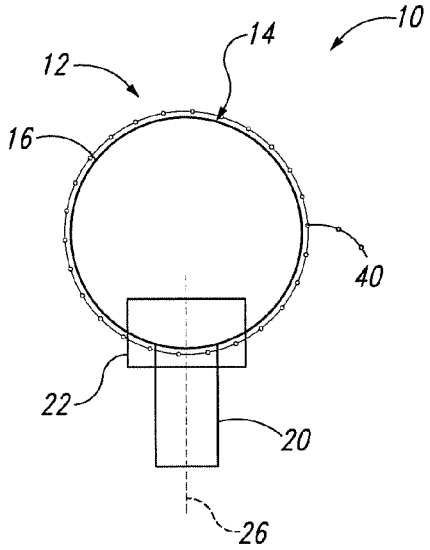
FIG. 2 is a schematic end view diagram representing illustrative, non-exclusive examples of twirling writing instrument bodies and twirling accessories for writing instruments.

A writing instrument 14 and the writing instrument body 16 thereof, whether of a twirling writing instrument body 10 or to which a twirling accessory 12 is (or is intended to be) operatively coupled, may be described as defining an elongation, that corresponds to a long dimension, or length, of the writing instrument 14 or the writing instrument body 16 thereof. A writing instrument 14 and a writing instrument body 16 also may be described as including a longitudinal axis, long axis, or central axis that corresponds to the long dimension, or length, of the writing instrument 14 or the writing instrument body 16 thereof. In some embodiments of twirling writing instrument bodies 10 (although not required), the gripping member 20 may project from the writing instrument body 16 transverse to the elongation. As an illustrative, non-exclusive example, the gripping member 20 may project transversely from the writing instrument body 16 in a perpendicular fashion to the elongation. Similarly, in some embodiments of twirling accessories 12, the connector 40 may be configured to be operatively coupled to a writing instrument 14 so that the gripping member 20 projects from the writing instrument 14 transverse to the elongation of the writing instrument 14. This optional relationship also is represented in the schematic end view of FIG. 2. Such configurations are in contrast to the gripping member 20 projecting parallel to the elongation of the writing instrument 14 or writing instrument body 16 thereof, such as from a terminal end of the writing instrument 14 or the writing instrument body 16 thereof. Additionally in some embodiments, the axis of rotation 26 at least approximately may intersect, or otherwise coincide with, a center of mass of the twirling writing instrument body 10.

Figure 3:
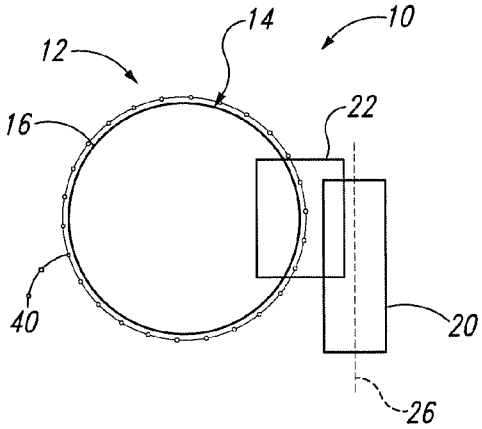
FIG. 3 is another schematic end view diagram representing illustrative, non-exclusive examples of twirling writing instrument bodies and twirling accessories for writing instruments.

In some embodiments of twirling writing instrument bodies 10, as represented in the schematic end view of FIG. 3, the gripping member 20 may be positioned adjacent to and offset from the writing instrument body 16, such that the axis of rotation 26 does not intersect, or otherwise coincide with, the elongation of the twirling writing instrument body 10 or the writing instrument body 16 thereof. Additionally or alternatively, in some such non-exclusive embodiments, as schematically represented in FIG. 3, the rotational axis 26 may not intersect the elongation of the writing instrument body 16. Similarly, in some embodiments of twirling accessories 12, the connector 40 may be configured to be operatively coupled to a writing instrument 14 so that the gripping member 20 is adjacent to and offset from the writing instrument 14 and its writing instrument body 16.

The gripping member 20 of a twirling writing instrument body 10 or of a twirling accessory 12 may take any suitable configuration. For example, a gripping member 20 may be sized and/or shaped to be held between a thumb and forefinger of a user's hand. Additionally or alternatively, a gripping member 20 may be sized and/or shaped to be held between adjacent knuckles of a user's hand. As schematically illustrated in FIG. 1, some gripping members 20 may include a distinct handle 30 (represented in dash-dot lines), or other structure that is specifically configured to be held by a user, that extends from, or that is otherwise operatively coupled to, a shaft 32. However, it also is within the scope of the present disclosure that a gripping member 20 simply includes a shaft 32 that is sized to be held by a user, without requiring a separate and distinct handle 30. In some embodiments, a gripping member 20 may include opposed gripping surfaces 34 that are sized and shaped to be engaged and grasped by a user. As illustrative, non-exclusive examples, each gripping surface 34 may have a surface area that normally does not exceed-4 square inches, and which usually is, but is not exclusively, in the range of 1/32-3 square inches, but surface areas outside of these ranges are within the scope of the present disclosure and may be incorporated into a twirling writing instrument body 10 and/or a twirling accessory 12. Other configurations of gripping members 20 also are within the scope of the present disclosure.

In some embodiments of twirling writing instrument bodies 10, the gripping member 20 may be configured to be selectively detached from the writing instrument body 16 and selectively reattached to the writing instrument body 16. Additionally or alternatively, the rotary assembly 22 of a twirling writing instrument body 10 may be configured for selective decoupling of the gripping member 20 from the rotary assembly 22 and/or from the writing instrument body 16, and for selective recoupling of the gripping member 20 to the rotary assembly 22 and/or the writing instrument body 16. Similarly, in some embodiments of twirling accessories 12, the gripping member 20 may be configured to be selectively detached from the rotary assembly 22 and/or the connector 40 and selectively reattached to the rotary assembly 22 and/or the connector 40. Additionally or alternatively, the rotary assembly 22 of a twirling accessory 12 may be configured for selective decoupling of the gripping member 20 from the rotary assembly 22 and/or the connector 40 and for selective recoupling of the gripping member 20 to the rotary assembly 22 and/or the connector 40. In such non-exclusive embodiments of twirling writing instrument bodies 10 and twirling accessories 12, this ability to repeatedly detach and reattach the gripping member 20 may be performed without destruction of the gripping member 20, the rotary assembly 22, the connector 40, and/or the writing instrument body 16.

In the context of twirling accessories 12, connectors 40 may take any suitable configuration such that they are configured for operatively coupling to a writing instrument 14. As an illustrative, non-exclusive example, a connector 40 may define a band that is configured to extend at least partially around, and in some embodiments, fully around, a writing instrument body 16. By around a writing instrument body 16, it is meant that the band extends around the elongation of the writing instrument body 16. For example, such a band generally may be circular in cross-section and may have an internal diameter that generally corresponds to an external diameter of a writing instrument body 16 to which the connector 40 is to be attached (operatively coupled) in a friction fit arrangement and/or a locking arrangement. Additionally or alternatively, a band may have an inner circumference that is generally circular and an outer circumference that is not circular, such as (but not limited to) being rectangular, triangular, polygonal, regular, non-regular. Additionally or alternatively, a band may have an inner circumference that is shaped to correspond to an outer surface or shape of a writing instrument body 16 to which the connector 40 is to be operatively coupled. In non-exclusive examples that include a band that extends only partially around a writing instrument body 16, the connector 40 may be described as defining a clip, or spring-clip. For example, when not attached (operatively coupled) to a writing instrument 14, the clip generally may define an internal diameter that is smaller than an external diameter of the associated writing instrument body 16, but such a clip may expand upon attachment (operatively coupling) to the associated writing instrument 14, such that it grips (operatively couples) the writing instrument body 16 with a friction fit arrangement and/or a locking arrangement.

Additionally or alternatively, as schematically illustrated in FIG. 1, some embodiments of twirling accessories 12 may include a fastener 42 (represented in dash-dot lines), such as a set screw, that is configured to operatively, and at least temporarily, affix (operatively couple) the connector 40 to a writing instrument 14.

In some embodiments of twirling accessories 12, the connector 40 may be configured for selective adjustment of its position along the length of the associated writing instrument 14 and/or for selective adjustment of its rotational position around the circumference of the associated writing instrument 14.

Figure 4:
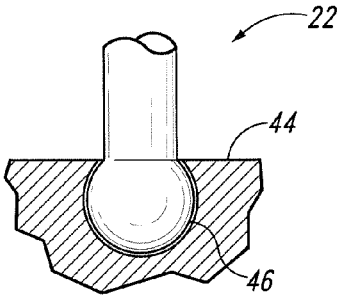
FIG. 4 is a partial cross-sectional side view schematically representing illustrative, non-exclusive examples of rotary assemblies.
Figure 5:
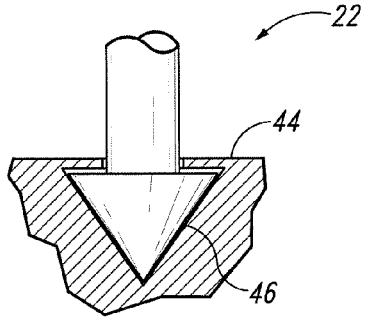
FIG. 5 is another partial cross-sectional side view schematically representing illustrative, non-exclusive examples of rotary assemblies.
Figure 6:
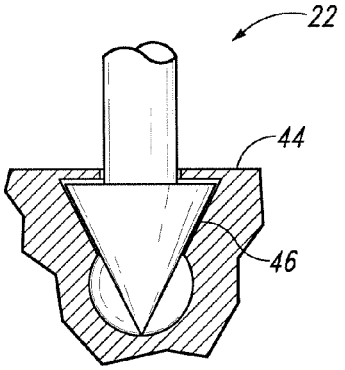
FIG. 6 is another partial cross-sectional side view schematically representing illustrative, non-exclusive examples of rotary assemblies.
Figure 7:
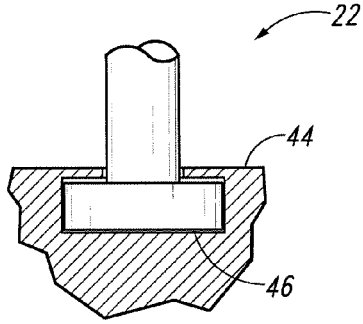
FIG. 7 is another partial cross-sectional side view schematically representing illustrative, non-exclusive examples of rotary assemblies.

Rotary assemblies 22 may take any suitable form, whether of, with, and/or a part of a twirling writing instrument body 10 or of a twirling accessory 12, such that they provide for selective rotation of a writing instrument 14 relative to a gripping member 20 held by a user. As an illustrative non-exclusive example, the rotary assembly 22 may include or be a female member, or socket, 44 and a male member 46 that is received by the female member 44, and thus the rotary assembly 22 may be configured to facilitate selective rotation of the female member 44 relative to the male member 46. For example, the rotary assembly 22 may define a ball-and-socket type joint that facilitates selective rotation of the writing instrument body 16 relative to the gripping member 20 in the context of a twirling writing instrument body 10. Similarly, in the context of a twirling accessory 12, the rotary assembly 22 may facilitate selective rotation of the connector 40 relative to the gripping member 20. FIG. 4 somewhat schematically illustrates in partial cross-section, a non-exclusive example of a rotary assembly 22 that includes or is a ball, or spherical, shaped male member 46 and a female member 44 that defines a spherical socket; however, other various configurations of male members 46 and corresponding female members 44 are within the scope of the present disclosure. For example, FIG. 5 illustrates a non-exclusive example of a rotary assembly 22 that includes or is a cone-shaped male member 46 and corresponding female member 46 that defines a cone-shaped socket. FIG. 6 illustrates a non-exclusive example of a rotary assembly 22 that includes or is a cone-shaped male member 46 and a female member 44 that defines a combination cone- and sphere-shaped socket. FIG. 7 illustrates a non-exclusive example of a rotary assembly 22 that includes or is a disc-shaped male member 46 and a female member 44 that defines a corresponding disc-shaped socket. Other configurations also are within the scope of the present disclosure.

In some embodiments of twirling writing instrument bodies 10, the writing instrument body 16 and/or rotary assembly 22 may define, or include, the female member 44, and the gripping member 20 may define, or include, the male member 46. In other embodiments of twirling writing instrument bodies 10, the writing instrument body 16 and/or rotary assembly 22 may define, or include, the male member 46, and the gripping member 20 may define, or include, the female member 44. Similarly, in some embodiments of twirling accessories 12, the connector 40 and/or rotary assembly 22 may define, or include, the female member 44, and the gripping member 20 may define, or include, the male member 46. In other embodiments of twirling accessories 12, the connector 40 and/or rotary assembly 22 may define, or include, the male member 46, and the gripping member 20 may define, or include, the female member 44. In some embodiments, the rotary assembly 22 may be described as defining a snap-fit arrangement (operatively coupled) between the female member 44 and the male member 46.

Figure 8:
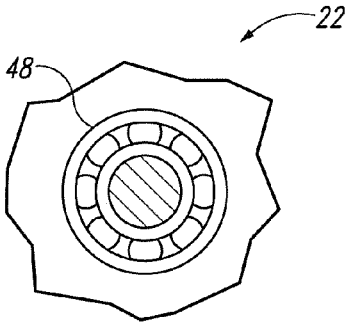
FIG. 8 is a partial cross-sectional plan view schematically representing illustrative, non-exclusive examples of rotary assemblies.
Figure 9:
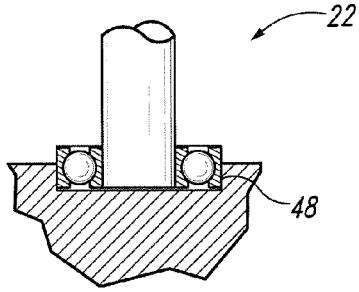
FIG. 9 is a partial cross-sectional side view schematically representing the illustrative, non-exclusive examples of rotary assemblies of FIG. 8.
Figure 10:
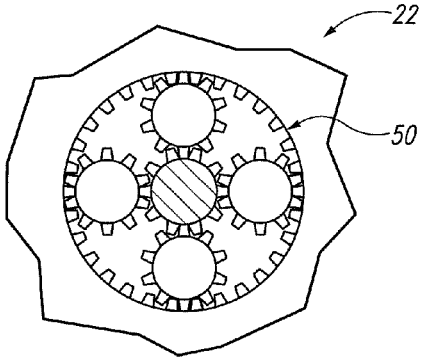
FIG. 10 is a partial cross-sectional plan view schematically representing illustrative, non-exclusive examples of rotary assemblies.
Figure 11:
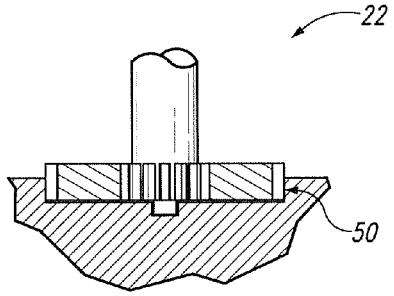
FIG. 11 is a partial cross-sectional side view schematically representing the illustrative, non-exclusive examples of rotary assemblies of FIG. 10.

Additionally or alternatively, as somewhat schematically illustrated in partial cross-section in FIGS. 8-9, a rotary assembly 22 may include or be a bearing assembly 48, such as to facilitate reduced-friction selective twirling of a writing instrument body 16 and/or a connector 40 relative to a gripping member 20. Additionally or alternatively, as illustrated in FIGS. 10-11, a rotary assembly 22 may include or be a gear assembly 50. In the non-exclusive illustrated example, the gear assembly 50 is in the form of a planetary gear assembly, but any suitable gear assembly may be incorporated into or be a rotary assembly 22 according to the present disclosure. Other configurations of rotary assemblies 22 also are within the scope of the present disclosure.

Additionally or alternatively, as schematically illustrated in FIG. 1, a rotary assembly 22 may include or be opposing and/or attracting magnets 52 that are configured to facilitate reduced-friction selective twirling of a writing instrument body 16 and/or a connector 40 relative to the gripping member 20. Again, other configurations of rotary assemblies 22 also are within the scope of the present disclosure.

Turning now to FIGS. 12-16, illustrative, non-exclusive examples of twirling accessories 12 and twirling writing instrument bodies 10 are illustrated. Because the examples of FIGS. 12-16 are non-exclusive, they do not limit the present disclosure to the illustrated embodiments of FIGS. 12-16. That is, neither twirling accessories 12 nor twirling writing instrument bodies 10 are limited to the specific embodiments illustrated in FIGS. 12-16, and twirling accessories 12 and twirling writing instrument bodies 10 may incorporate any number of the various aspects, configurations, characteristics, properties, etc. that are illustrated in and discussed with reference to the schematic representations of FIGS. 1-11 and/or the embodiments of FIGS. 12-16, as well as variations thereof, without requiring the inclusion of all such aspects, configurations, characteristics, properties, etc. For the purpose of brevity, each previously discussed component, part, portion, aspect, region, etc. or variants thereof need not be discussed, illustrated, and/or labeled again with respect to the embodiments of FIGS. 12-16.

Figure 12:
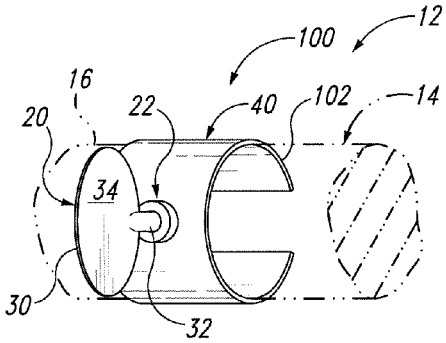
FIG. 12 is an isometric view of an illustrative, non-exclusive example of a twirling accessory.

The illustrative, non-exclusive example of a twirling accessory 12 illustrated in FIG. 12 is indicated generally at 100. Twirling accessory 100 is a non-exclusive example of a twirling accessory 12 that includes a connector 40 that includes a band in the form of a clip 102 that is configured to extend partially around the writing instrument body 16 of a corresponding writing instrument 14 (represented in dash-double-dot lines). Depending on the configuration of the associated writing instrument 14, the twirling accessory 100 may be snapped (operatively coupled) around the writing instrument body 16. Additionally or alternatively, the twirling accessory 100 may begin being operatively coupled to the writing instrument body 16 of a writing instrument 14 from a terminal end thereof, then permitting a user to slide the twirling accessory 100 to a desired position along the length of the writing instrument 14.

Twirling accessory 100 is a non-exclusive example of a twirling accessory 12 that includes a gripping member 20 having a shaft 32 and a handle 30 with opposed gripping surfaces 34. The rotary assembly 22 may take any suitable configuration, as discussed herein, and without limitation to additional or alternative configurations.

Figure 13:
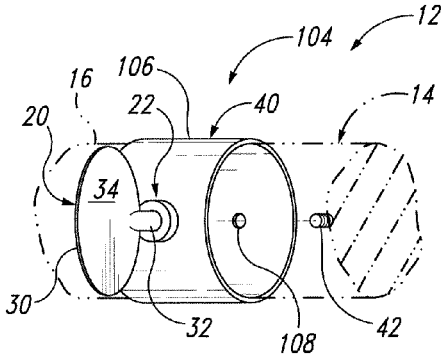
FIG. 13 is an isometric view of another illustrative, non-exclusive example of a twirling accessory.

The illustrative, non-exclusive example of a twirling accessory 12 illustrated in FIG. 13 is indicated generally at 104. Twirling accessory 104 is a non-exclusive example of a twirling accessory 12 that includes a connector 40 that includes a band 106 that is configured to extend fully around the writing instrument body 16 of a corresponding writing instrument 14 (represented in dash-double-dot lines). Twirling accessory 104 also includes a fastener 42 in the form of a set screw. The band 106 includes a corresponding threaded bore 108 for receiving the fastener 42. Accordingly, a user may selectively position the band 106 around the writing instrument body 16 of a writing instrument 14 from a terminal end thereof, position the twirling accessory 104 in a desired position along the length of the writing instrument 14 and in a desired rotational position around the circumference of the writing instrument 14, and then tighten the set screw to affix (operatively couple) the twirling accessory 104 in a desired position.

Similar to twirling accessory 100, twirling accessory 104 is a non-exclusive example of a twirling accessory 12 that includes a gripping member 20 that has a shaft 32 and a handle 30 with opposed gripping surfaces 34. Moreover, the connector 40 and the gripping member 20 of twirling accessory 104 operatively couple the rotary assembly 22, which may take any suitable configuration, as discussed herein, and without limitation to additional or alternative configurations.

Figure 14:
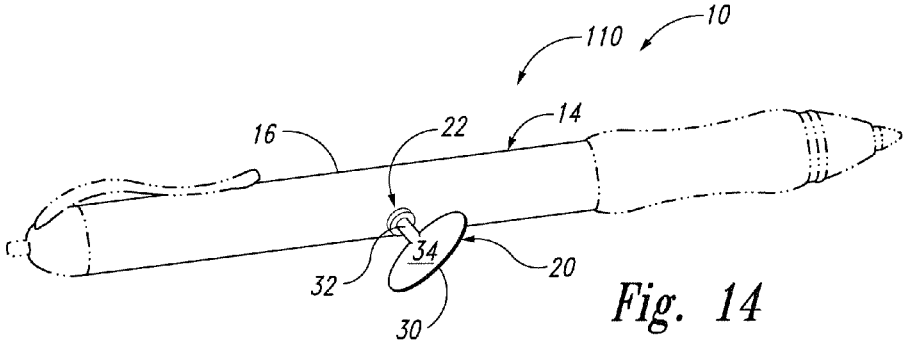
FIG. 14 is an isometric view of an illustrative, non-exclusive example of a twirling writing instrument body.

The illustrative, non-exclusive example of a twirling writing instrument body 10 illustrated in FIG. 14 is indicated generally at 110 and may be described as a twirling pen 110. Twirling pen 110 is a non-exclusive example of a twirling writing instrument body 10 used in a writing instrument 14 that includes a gripping member 20 that has a shaft 32 and a handle 30 with opposed gripping surfaces 34. The gripping member 20 and the writing instrument body 16 of twirling pen 110 are operatively coupled by the rotary assembly 22 of the twirling pen 110, and any suitable configuration of rotary assembly 22 may be incorporated into twirling pen 110.

Figure 15:
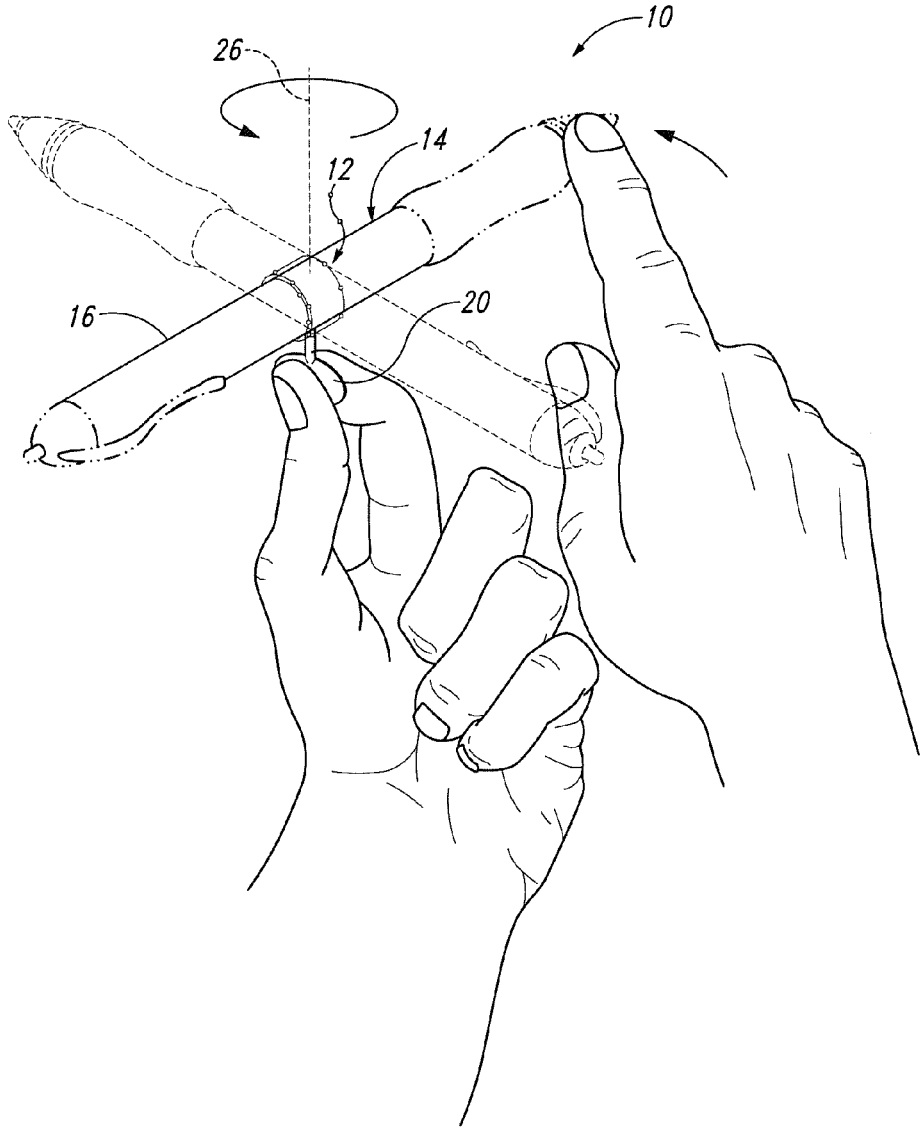
FIG. 15 is a perspective view of an illustrative, non-exclusive example of a twirling writing instrument body while being held and twirled by a user.

FIG. 15 graphically illustrates the use of illustrative, non-exclusive examples of twirling writing instrument bodies 10 and twirling accessories 12 according to the present disclosure. In the illustrated non-exclusive example of FIG. 15, the rotational axis 26 intersects the elongation of the writing instrument body 16 and at least approximately coincides with the center of mass of the writing instrument 14. As illustrated, a user may grasp the gripping member 20 with one hand, and actively twirl the writing instrument 14 by flicking, tapping, or otherwise rotating the writing instrument 14 with the user's other hand.

Figure 16:
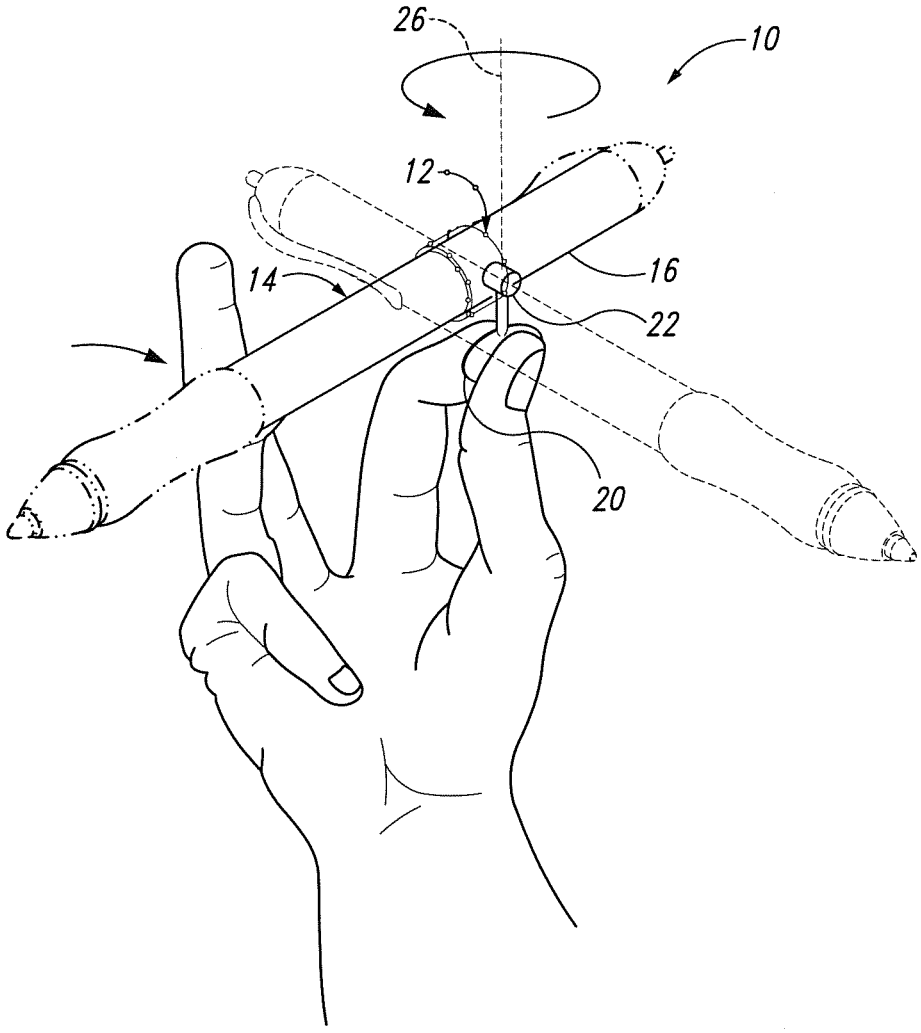
FIG. 16 is a perspective view of another illustrative, non-exclusive example of a twirling writing instrument body while being held and twirled by a user.

FIG. 16 graphically illustrates the use of other illustrative, non-exclusive examples of twirling writing instrument bodies 10 and twirling accessories 12 according to the present disclosure. In the illustrated non-exclusive example of FIG. 16, the gripping member is offset from the elongation of the writing instrument body 16 of the writing instrument 14 and the rotational axis 26 is offset from and does not coincide with the elongation of the writing instrument body 16. In this illustration of FIG. 16, the gripping member 20 is held between a user's thumb and forefinger, and the writing instrument 14 is being twirled with other fingers of the same hand.

As it relates to the present disclosure and as discussed herein, various methods of twirling a writing instrument 14 are within the scope of the present disclosure, and FIGS. 15-16 are provided as non-exclusive examples only for purposes of illustration. Moreover, the active use of twirling writing instrument bodies 10 and/or twirling accessories 12 may be described as methods of amusement, methods of holding a writing instrument, and/or methods of playing with a writing instrument.

Illustrative, non-exclusive examples of inventive subject matter according to the present disclosure are described in the following enumerated paragraphs:

A. A twirling writing instrument body, comprising:

a writing instrument body;

a gripping member; and a rotary assembly that operatively couples the gripping member to the writing instrument body, wherein the rotary assembly is configured to facilitate selective twirling of the writing instrument body relative to the gripping member by a user.

A1. The twirling writing instrument body of paragraph A, wherein the writing instrument body is a pen body, a pencil body, a marker body, or a stylus body.

A2. The twirling writing instrument body of any of paragraphs A-A1, wherein the writing instrument body is configured to support and/or protect marking material.

A3. The twirling writing instrument body of any of paragraphs A-A2, wherein the gripping member has opposed gripping surfaces.

A4. The twirling writing instrument body of any of paragraphs A-A3, wherein the gripping member is sized to be held between a thumb and forefinger of the user.

A5. The twirling writing instrument body of any of paragraphs A-A4, wherein the gripping member projects from the writing instrument body in a transverse direction;

wherein the rotary assembly defines an axis of rotation, about which the writing instrument body is permitted to be selectively rotated relative to the gripping member; and wherein the axis of rotation intersects the writing instrument body.

A6. The twirling writing instrument body of paragraph A5, wherein the axis of rotation approximately coincides with a center of mass of the writing instrument body.

A7. The twirling writing instrument body of paragraph A5, wherein the axis of rotation does not approximately coincide with a center of mass of the writing instrument body.

A8. The twirling writing instrument body of any of the paragraphs A-A7, wherein the gripping member is offset from and transverse to the writing instrument body;

wherein the rotary assembly defines an axis of rotation, about which the writing instrument body is permitted to be selectively rotated relative to the gripping member; and wherein the axis of rotation does not intersect the writing instrument body.

A9. The twirling writing instrument body of any of paragraphs A-A8, wherein the rotary assembly is configured to facilitate selective twirling of the writing instrument body relative to the gripping member for an undefined number of rotations.

A10. The twirling writing instrument body of any of paragraphs A-A9, wherein the rotary assembly includes or is a female member and a male member;

wherein the male member is received by the female member; and wherein the rotary assembly is configured to facilitate selective rotation of the female member relative to the male member.

A11. The twirling writing instrument body of paragraph A10, wherein the male member is generally conical and the female member defines a combined cone- and sphere-shaped socket.

A12. The twirling writing instrument body of paragraph A10, wherein the male member is generally sphere-shaped and the female member defines a sphere-shaped socket.

A13. The twirling writing instrument body of paragraph A10, wherein the male member is generally conical-shaped and the female member defines a conical-shaped socket.

A14. The twirling writing instrument body of paragraph A10, wherein the male member is generally disc-shaped and the female member defines a disc-shaped socket.

A15. The twirling writing instrument body of any of paragraphs A-A14, wherein the rotary assembly includes or is a bearing assembly.

A16. The twirling writing instrument body of any of paragraphs A-A15, wherein the rotary assembly includes or is a gear assembly.

A17. The twirling writing instrument body of any of paragraphs A-A16, wherein the rotary assembly is configured for selective operatively decoupling of the gripping member from the writing instrument body and for selective operatively recoupling of the gripping member to the writing instrument body.

A18. The twirling writing instrument body of any of paragraphs A-A17, wherein the rotary assembly includes or is opposing and/or attracting magnets configured to facilitate reduced-friction selective twirling of the writing instrument body relative to the gripping member.

A19. A twirling writing instrument body, comprising the subject matter of any of paragraphs A-A18.

B. A twirling accessory for writing instruments, comprising:

a gripping member;

a connector configured to be operatively coupled to a writing instrument body; and a rotary assembly that operatively couples the gripping member to the connector, wherein the rotary assembly is configured to facilitate selective twirling of the connector relative to the gripping member by a user.

B1. The twirling accessory of paragraph B, wherein the gripping member has opposed gripping surfaces.

B2. The twirling accessory of any of paragraphs B-B1, wherein the gripping member is sized to be held between a thumb and forefinger of the user.

B3. The twirling accessory of any of paragraphs B-B2, wherein the gripping member projects from the connector in a transverse direction;

wherein the rotary assembly defines an axis of rotation, about which the connector is permitted to be selectively rotated relative to the gripping member; and wherein the connector is configured to be operatively coupled to a writing instrument body so that the axis of rotation intersects a writing instrument body.

B4. The twirling accessory of paragraph B3, wherein the axis of rotation approximately coincides with a center of mass of the connector.

B5. The twirling accessory of paragraph B3, wherein the axis of rotation does not approximately coincide with a center of mass of the connector.

B6. The twirling accessory of any of paragraphs B-B5, wherein the gripping member is offset from and transverse to the connector;

wherein the rotary assembly defines an axis of rotation, about which the connector is permitted to be selectively rotated relative to the gripping member; and wherein the connector is configured to be operatively coupled to a writing instrument body so that the axis of rotation does not intersect a writing instrument body.

B7. The twirling accessory of any of paragraphs B-B6, wherein the rotary assembly is configured to facilitate selective twirling of the connector relative to the gripping member for an undefined number of rotations.

B8. The twirling accessory of any of paragraphs B-B7, wherein the rotary assembly includes or is a female member and a male member;

wherein the male member is received by the female member; and wherein the rotary assembly is configured to facilitate selective rotation of the female member relative to the male member.

B9. The twirling accessory of paragraph B8, wherein the male member is generally conical and the female member defines a combined cone- and sphere-shaped socket.

B10. The twirling accessory of paragraph B8, wherein the male member is generally sphere-shaped and the female member defines a sphere-shaped socket.

B11. The twirling accessory of paragraph B8, wherein the male member is generally conical-shaped and the female member defines a conical-shaped socket.

B12. The twirling accessory of paragraph B8, wherein the male member is generally disc-shaped and the female member defines a disc-shaped socket.

B13. The twirling accessory of any of paragraphs B-B12, wherein the rotary assembly includes or is a bearing assembly.

B14. The twirling accessory of any of paragraphs B-B13, wherein the rotary assembly includes or is a gear assembly.

B15. The twirling accessory of any of paragraphs B-B14, wherein the rotary assembly is configured for selective operatively decoupling of the gripping member from the connector and for selective operatively recoupling of the gripping member to the connector.

B16. The twirling accessory of any of paragraphs B-B15, wherein the rotary assembly includes or is opposing and/or attracting magnets configured to facilitate reduced-friction selective twirling of the connector relative to the gripping member.

B17. The twirling accessory of any of paragraphs B-B16, wherein the connector defines a clip that is configured to extend at least partially around a writing instrument body for selective and repeated operatively coupling to and decoupling from a writing instrument body.

B18. The twirling accessory of any of paragraphs B-B17, wherein the connector defines a band that is configured to extend entirely around a writing instrument body for selective and repeated operatively coupling to and decoupling from a writing instrument body.

B19. The twirling accessory of any of paragraphs B-B18, wherein the connector is configured to be operatively coupled to a pen body, a pencil body, a marker body, or a stylus body.

B20. The twirling accessory of any of paragraphs B-B19, wherein the connector is adjustable along a/the length of a writing instrument body and/or adjustable around a/the circumference of a writing instrument body.

B21. A twirling accessory, comprising the subject matter of any of paragraphs B-B20.

C. A method of amusement, comprising:

providing the twirling writing instrument body of any of paragraphs A-A19;

grasping the gripping member; and twirling the writing instrument body relative to the gripping member.

C1. The method of paragraph C, wherein the grasping includes grasping the gripping member with a user's hand; and wherein the twirling includes twirling the writing instrument body with the user's same hand.

C2. The method of paragraph C, wherein the grasping includes grasping the gripping member with a user's hand; and wherein the twirling includes twirling the writing instrument body with the user's other hand.

D. A method of amusement, comprising:

providing the twirling accessory of any of paragraphs B-B21;

operatively coupling the connector to the writing instrument;

grasping the gripping member; and twirling the writing instrument relative to the gripping member.

D1. The method of paragraph D, wherein the grasping includes grasping the gripping member with a user's hand; and wherein the twirling includes twirling the writing instrument with the user's same hand.

D2. The method of paragraph D, wherein the grasping includes grasping the gripping member with a user's hand; and wherein the twirling includes twirling the writing instrument body with the user's other hand.

E. A method of holding a writing instrument, comprising the method of any of paragraphs C-C2 and D-D2.

F. A method for using writing instruments as toys, comprising:

providing a connector that has a gripping member and a rotary assembly which operatively couples the gripping member to the connector;

operatively coupling the connector with a writing instrument;

grasping the gripping member; and twirling the connector relative to the gripping member.

F1. The method of paragraph F, wherein the grasping includes grasping the gripping member with a user's hand; and wherein the twirling includes twirling the writing instrument with the user's same hand.

F2. The method of paragraph F, wherein the grasping includes grasping the gripping member with a user's hand; and wherein the twirling includes twirling the writing instrument body with the user's other hand.

G. A method for using writing instruments as toys, comprising:

providing a writing instrument body that has a gripping member and a rotary assembly which operatively couples the gripping member to the writing instrument body;

using the writing instrument body in a writing instrument;

grasping the gripping member; and twirling the writing instrument body relative to the gripping member.

G1. The method of paragraph G, wherein the grasping includes grasping the gripping member with a user's hand; and wherein the twirling includes twirling the writing instrument with the user's same hand.

G2. The method of paragraph G, wherein the grasping includes grasping the gripping member with a user's hand; and wherein the twirling includes twirling the writing instrument body with the user's other hand.

H. A method of playing with writing instruments, comprising the method of any of paragraphs F-F2 and G-G2.

As used herein, the terms "selective" and "selectively," when modifying an action, movement, configuration, or other activity of one or more components or characteristics of an apparatus, mean that the specific action, movement, configuration, or other activity is a direct or indirect result of user manipulation of an aspect of, or one or more components of, the apparatus.

As used herein, the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, and/or designed for the purpose of performing the function. It is also within the scope of the present disclosure that elements, components, and/or other recited subject matter that is recited as being adapted to perform a particular function may additionally or alternatively be described as being configured to perform that function, and vice versa. Similarly, subject matter that is recited as being configured to perform a particular function may additionally or alternatively be described as being operative to perform that function.

In the event that any of the patent documents that are incorporated by reference herein define or use a term in a manner that is inconsistent with either the non-incorporated disclosure of the present application or with any of the other incorporated patent documents, the non-incorporated disclosure of the present application shall control with respect to the present application, and the term or terms as used in an incorporated patent document shall only control with respect to the document in which the term or terms are defined or used.

The various disclosed elements of apparatuses and steps of methods disclosed herein are not required to all apparatuses and methods according to the present disclosure, and the present disclosure includes all novel and non-obvious combinations and subcombinations of the various elements and steps disclosed herein. Moreover, one or more of the various elements and steps disclosed herein may define independent inventive subject matter that is separate and apart from the whole of a disclosed apparatus or method. Accordingly, such inventive subject matter is not required to be associated with the specific apparatuses and methods that are expressly disclosed herein, such inventive subject matter may find utility in future apparatuses and/or methods and may be claimed through amendment of the present claims or presentation of new claims in this or a related application.

The specific alternatives, embodiments, and/or methods thereof as disclosed and illustrated herein are not to be considered in a limiting sense, as numerous variations are possible. The present disclosure includes all novel and non-obvious combinations and subcombinations of the various elements, features, functions, properties, methods, and/or steps disclosed herein. The following claims particularly point out certain combinations and subcombinations that are directed to one of the disclosed inventions and are novel and non-obvious. Inventions embodied in other combinations and subcombinations of features, functions, elements, properties, methods, and/or steps may be claimed through amendment of the present claims or presentation of new claims in this or a related application. Such amended or new claims, whether they are directed to a different invention or directed to the same invention, whether different, broader, narrower, or equal in scope to the original claims, also are regarded as within the subject matter of the present disclosure.

I claim:

1. A twirling writing instrument body, comprising:

a writing instrument body;

a gripping member for a user to grip onto, wherein the gripping member has a shaft that extends between the gripping member and the writing instrument body, and wherein the gripping member extends in a transverse direction relative to a longitudinal direction of the writing instrument body; and a rotary assembly that operatively couples the gripping member to the writing instrument body, wherein longitudinal ends of the writing instrument body are free of the rotary assembly and the gripping member, and wherein the rotary assembly is configured to facilitate selective twirling of the writing instrument body relative to the gripping member by a user.

2. The twirling writing instrument body of claim 1, wherein the writing instrument body is a pen body, a pencil body, a marker body, or a stylus body.

3. The twirling writing instrument body of claim 1, wherein the writing instrument body is configured to support and/or protect marking material.

4. The twirling writing instrument body of claim 1, wherein the gripping member has opposed gripping surfaces.

5. The twirling writing instrument body of claim 1, wherein the gripping member is sized to be held between a thumb and forefinger of the user.

6. The twirling writing instrument body of claim 1, wherein the rotary assembly defines an axis of rotation, about which the writing instrument body is permitted to be selectively rotated relative to the gripping member; and wherein the axis of rotation intersects the writing instrument body.

7. The twirling writing instrument body of claim 6, wherein the axis of rotation approximately coincides with a center of mass of the writing instrument body.

8. The twirling writing instrument body of claim 6, wherein the axis of rotation does not approximately coincide with a center of mass of the writing instrument body.

9. The twirling writing instrument body of claim 1, wherein the gripping member is offset from the writing instrument body;

wherein the rotary assembly defines an axis of rotation, about which the writing instrument body is permitted to be selectively rotated relative to the gripping member; and wherein the axis of rotation does not intersect the writing instrument body.

10. The twirling writing instrument body of claim 1, wherein the rotary assembly is configured to facilitate selective twirling of the writing instrument body relative to the gripping member for an undefined number of rotations.

11. The twirling writing instrument body of claim 1, wherein the rotary assembly includes or is a female member and a male member;

wherein the male member is received by the female member; and wherein the rotary assembly is configured to facilitate selective rotation of the female member relative to the male member.

12. The twirling writing instrument body of claim 11, wherein the male member is generally conical and the female member defines a combined cone- and sphere-shaped socket.

13. The twirling writing instrument body of claim 11, wherein the male member is generally sphere-shaped and the female member defines a sphere-shaped socket.

14. The twirling writing instrument body of claim 1, wherein the rotary assembly includes or is a bearing assembly.

15. The twirling writing instrument body of claim 1, wherein the rotary assembly includes or is a gear assembly.

16. The twirling writing instrument body of claim 1, wherein the rotary assembly is configured for selective operatively decoupling of the gripping member from the writing instrument body and for selective operatively recoupling of the gripping member to the writing instrument body.

17. A method of amusement, comprising:
providing the twirling writing instrument body of claim 1;
grasping the gripping member; and
twirling the writing instrument body relative to the gripping member.

18. A twirling accessory for writing instruments, comprising:
a connector configured to be operatively coupled to a writing instrument body so that longitudinal ends of the writing instrument body are free of the connector;
a gripping member for a user to grip onto, wherein the gripping member has a shaft that extends between the gripping member and the connector, and wherein the gripping member extends in a transverse direction relative to a longitudinal direction of a writing instrument body when the connector is operatively coupled to a writing instrument body; and
a rotary assembly that operatively couples the gripping member to the connector, wherein the rotary assembly is configured to facilitate selective twirling of the connector relative to the gripping member by a user.

19. The twirling accessory of claim 18, wherein the gripping member has opposed gripping surfaces.

20. The twirling accessory of claim 18, wherein the gripping member is sized to be held between a thumb and forefinger of the user.

21. The twirling accessory of claim 18,
wherein the rotary assembly defines an axis of rotation, about which the connector is permitted to be selectively rotated relative to the gripping member; and
wherein the connector is configured to be operatively coupled to a writing instrument body so that the axis of rotation intersects a writing instrument body.

22. The twirling accessory of claim 21, wherein the axis of rotation approximately coincides with a center of mass of the connector.

23. The twirling accessory of claim 21, wherein the axis of rotation does not approximately coincide with a center of mass of the connector.

24. The twirling accessory of claim 18,
wherein the gripping member is offset from the connector;
wherein the rotary assembly defines an axis of rotation, about which the connector is permitted to be selectively rotated relative to the gripping member; and
wherein the connector is configured to be operatively coupled to a writing instrument body so that the axis of rotation does not intersect a writing instrument body.

25. The twirling accessory of claim 18, wherein the rotary assembly is configured to facilitate selective twirling of the connector relative to the gripping member for an undefined number of rotations.

26. The twirling accessory of claim 18,
wherein the rotary assembly includes or is a female member and a male member;
wherein the male member is received by the female member; and
wherein the rotary assembly is configured to facilitate selective rotation of the female member relative to the male member.

27. The twirling accessory of claim 26, wherein the male member is generally conical and the female member defines a combined cone- and sphere-shaped socket.

28. The twirling accessory of claim 26, wherein the male member is generally sphere-shaped and the female member defines a sphere-shaped socket.

29. The twirling accessory of claim 18, wherein the rotary assembly includes or is a bearing assembly.

30. The twirling accessory of claim 18, wherein the rotary assembly includes or is a gear assembly.

31. The twirling accessory of claim 18, wherein the rotary assembly is configured for selective operatively decoupling of the gripping member from the connector and for selective operatively recoupling of the gripping member to the connector.

32. The twirling accessory of claim 18, wherein the connector defines a clip that is configured to extend at least partially around a writing instrument body for selective and repeated operatively coupling to and decoupling from a writing instrument body.

33. The twirling accessory of claim 18, wherein the connector defines a band that is configured to extend entirely around a writing instrument body for selective and repeated operatively coupling to and decoupling from a writing instrument body.

34. The twirling accessory of claim 18, wherein the connector is configured to be operatively coupled to a pen body, a pencil body, a marker body, or a stylus body.

35. The twirling accessory of claim 18, wherein the connector is adjustable along a length of a writing instrument body and/or adjustable around a circumference of a writing instrument body.

36. A method of amusement, comprising:
providing the twirling accessory of claim 18;
operatively coupling the connector to a writing instrument body;
grasping the gripping member; and
twirling the writing instrument body relative to the gripping member.

37. A method for using writing instruments as toys, comprising:
providing a connector, a gripping member for a user to grip onto, wherein the gripping member has a shaft that extends between the gripping member and the connector, and a rotary assembly which operatively couples the gripping member to the connector;
operatively coupling the connector with a writing instrument, so that longitudinal ends of the writing instrument's body are free of the connector, and so that the gripping member extends in a transverse direction relative to a longitudinal direction of the writing instrument;
grasping the gripping member; and
twirling the connector relative to the gripping member.

38. A method for using writing instruments as toys, comprising:
providing a writing instrument body, a gripping member for a user to grip onto, wherein the gripping member has a shaft that extends between the gripping member and the writing instrument body, and wherein the gripping member extends in a transverse direction relative to a longitudinal direction of the writing instrument body, and a rotary assembly that operatively couples the gripping member to the writing instrument body, wherein longitudinal ends of the writing instrument body are free of the rotary assembly and the gripping member;
using the writing instrument body in a writing instrument;
grasping the gripping member; and
twirling the writing instrument body relative to the gripping member.

39. A method for twirling a writing instrument body, comprising:
providing a writing instrument body, a gripping member for a user to grip onto, wherein the gripping member has a shaft that extends between the gripping member and the writing instrument body, and wherein the gripping member extends in a transverse direction relative to a longitudinal direction of the writing instrument body, and a rotary assembly that operatively couples the gripping member to the writing instrument body, wherein longitudinal ends of the writing instrument body are free of the rotary assembly and the gripping member;

gripping the gripping member; and twirling the writing instrument body relative to the gripping member.

* * * * *